US010788260B2

(12) United States Patent
Johnston et al.

(10) Patent No.: US 10,788,260 B2
(45) **Date of Patent: *Sep. 29, 2020**

(54) REFRIGERANT RECOVERY IN NATURAL GAS LIQUEFACTION PROCESSES

(71) Applicant: AIR PRODUCTS AND CHEMICALS, INC., Allentown, PA (US)

(72) Inventors: Brian Keith Johnston, Schnecksville, PA (US); Gowri Krishnamurthy, Sellersville, PA (US); Mark Julian Roberts, Kempton, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 277 days.

This patent is subject to a terminal disclaimer.

(21) Appl. No.: 15/671,622

(22) Filed: Aug. 8, 2017

(65) Prior Publication Data

US 2018/0058752 A1 Mar. 1, 2018

Related U.S. Application Data

(63) Continuation of application No. 14/511,774, filed on Oct. 10, 2014, now Pat. No. 9,759,480.

(51) Int. Cl.

| | |
|---|---|
| ***F25J 1/00*** | (2006.01) |
| ***F25J 1/02*** | (2006.01) |
| ***F25J 3/02*** | (2006.01) |

(52) U.S. Cl.

CPC ..... *F25J 1/0022* (2013.01); *F25J 1/0055* (2013.01); *F25J 1/0092* (2013.01); *F25J 1/0097* (2013.01);

(Continued)

(58) Field of Classification Search

CPC ... F25J 1/0211–0219; F25J 1/0248–025; F25J 2270/902

See application file for complete search history.

(56) References Cited

U.S. PATENT DOCUMENTS

| | | | |
|---|---|---|---|
| 3,393,527 | A | 7/1968 | Swenson et al. |
| 3,581,511 | A | 6/1971 | Peck |

(Continued)

FOREIGN PATENT DOCUMENTS

| | | |
|---|---|---|
| CN | 102893108 | 1/2013 |
| EP | 0252455 | 1/1988 |
| GB | 1135872 | 12/1968 |

OTHER PUBLICATIONS ip.com Disclosure No. IPCCOM000215855D, Preventing Over-Pressurization of Wound Coil Exchangers by Cooling with LNB, Mar. 13, 2012.

*Primary Examiner* — Keith M Raymond
*Assistant Examiner* — Webeshet Mengesha
(74) *Attorney, Agent, or Firm* — Amy Carr-Trexler

(57) ABSTRACT

Described herein is a method of removing refrigerant from a natural gas liquefaction system in which vaporized mixed refrigerant is withdrawn from the closed-loop refrigeration circuit and introduced into a distillation column so as to be separated into an overhead vapor enriched in methane and a bottoms liquid enriched in heavier components. Overhead vapor is withdrawn from the distillation column to form a methane enriched stream that is removed from the liquefaction system, and bottoms liquid is reintroduced from the distillation column into the closed-loop refrigeration circuit. Also described are methods of altering the rate of production in a natural gas liquefaction system in which refrigerant is removed as described above, and a natural gas liquefaction systems in which such methods can be carried out.

19 Claims, 6 Drawing Sheets

(52) U.S. Cl.
CPC ..... *F25J 1/025* (2013.01); *F25J 1/0212* (2013.01); *F25J 1/0214* (2013.01); *F25J 1/0216* (2013.01); *F25J 1/0245* (2013.01); *F25J 1/0248* (2013.01); *F25J 1/0249* (2013.01); *F25J 1/0292* (2013.01); *F25J 3/0209* (2013.01); *F25J 3/0233* (2013.01); *F25J 3/0238* (2013.01); *F25J 2200/02* (2013.01); *F25J 2200/74* (2013.01); *F25J 2205/30* (2013.01); *F25J 2210/62* (2013.01); *F25J 2245/02* (2013.01); *F25J 2260/20* (2013.01); *F25J 2270/902* (2013.01); *F25J 2270/904* (2013.01); *F25J 2290/62* (2013.01)

(56) References Cited

U.S. PATENT DOCUMENTS

| | | | |
|---|---|---|---|
| 3,735,600 | A | 5/1973 | Dowdell et al. |
| 3,792,590 | A | 2/1974 | Lofredo et al. |
| 4,809,154 | A | 2/1989 | Newtown |
| 5,139,548 | A | 8/1992 | Liu et al. |
| 5,265,427 | A | 11/1993 | Stone et al. |
| 5,791,160 | A | 8/1998 | Mandler et al. |
| 6,276,167 | B1 | 8/2001 | McCaulley |
| 6,691,531 | B1 | 2/2004 | Martinez et al. |
| 7,266,975 | B2 | 9/2007 | Hupkes et al. |
| 7,451,618 | B2 | 11/2008 | Ansorge et al. |
| 2008/0115530 | A1 | 5/2008 | Mock et al. |
| 2010/0293996 | A1 | 11/2010 | Van Aken et al. |
| 2011/0036121 | A1 | 2/2011 | Roberts et al. |
| 2012/0017639 | A1 | 1/2012 | Peterson et al. |
| 2012/0167616 | A1 | 7/2012 | Burger et al. |
| 2012/0255325 | A1 | 10/2012 | Prim |
| 2013/0133362 | A1 | 5/2013 | Lee et al. |
| 2014/0075986 | A1 | 3/2014 | Hodges |

REFRIGERANT RECOVERY IN NATURAL GAS LIQUEFACTION PROCESSES

CROSS-REFERENCE TO RELATED APPLICATIONS

The present application is a continuation application and claims the benefit of priority of U.S. application Ser. No. 14/511,774, filed Oct. 10, 2014.

BACKGROUND

The present invention relates to methods of removing refrigerant from a natural gas liquefaction system that uses a mixed refrigerant to liquefy and/or subcool natural gas, and to methods of altering the rate of production of liquefied or subcooled natural gas in which refrigerant is removed from the liquefaction system during shutdown or turn-down of production. The present invention also relates to natural gas liquefaction systems in which the above-mentioned methods can be carried out.

A number of liquefaction systems for liquefying, and optionally subcooling, natural gas are well known in the art. Typically, in such systems natural gas is liquefied, or liquefied and subcooled, by indirect heat exchange with one or more refrigerants. In many such systems a mixed refrigerant is used as the refrigerant or one of the refrigerants. Typically, the mixed refrigerant is circulated in a closed-loop refrigeration circuit, the closed-loop refrigeration circuit including a main heat exchanger through which natural gas is fed to be liquefied and/or subcooled by indirect heat exchange with the circulating mixed refrigerant. Examples of such refrigeration cycles include the single mixed refrigerant (SMR) cycle, propane-precooled mixed refrigerant (C3MR) cycle, dual mixed refrigerant (DMR) cycle and C3MR-Nitrogen hybrid (such as AP-X™) cycle.

During normal (steady state) operation of a such systems the mixed refrigerant circulates inside the closed-loop refrigeration circuit and is not intentionally removed from the circuit. Vaporized, warmed refrigerant exiting the main heat exchanger is typically compressed, cooled, at least partially condensed and then expanded (the closed-loop refrigeration circuit therefore typically including also one or more compressors, coolers and expansion devices) before being returned to the main heat exchanger as cold vaporized or vaporizing refrigerant to provide again cooling duty to the main heat exchanger. Minor amounts of mixed refrigerant may be lost over time, for example as a result of small leakages from the circuit, which may in turn require small amount of make-up refrigerant to be added, but in general no or minimal amounts of refrigerant are removed from or added to the circuit during normal operation.

However, under upset conditions, such as during shut down or turn down of the liquefaction system, mixed refrigerant may have to be removed from the closed-loop refrigeration circuit. During shut down, with the compressors, coolers and main heat exchanger out of operation, the temperature and hence the pressure of the mixed refrigerant inside the closed-loop refrigeration circuit will steadily rise over time as a result of ambient warming of the circuit, which in turn will necessitate removal of refrigerant from the circuit prior to the point at which the build of pressure is likely to lead to damage to the main heat exchanger or any other components of the circuit. During turn-down the inventory of the mixed refrigerant may need to be adjusted to properly match the reduced production rate (more specifically, the reduced amount of cooling duty required in the main heat exchanger) which again necessitates removal of some of the refrigerant from the closed-loop refrigeration circuit.

Refrigerant removed from the closed-loop refrigeration circuit may simply be vented or flared, but often the refrigerant is a valuable commodity, which makes this undesirable. In order to avoid this, another option that has been adopted in the art is to store the refrigerant removed from the closed-loop refrigeration circuit in a storage vessel so that it can be retained and subsequently returned to the closed-loop refrigeration circuit. However, this solution also involves operational difficulties. Mixed refrigerant removed from the the closed-loop refrigeration circuit typically will still need to be continuously cooled in order to for it to be stored in an at least partially condensed state, so as to avoid excessive storage pressures and/or volumes. Providing this cooling and condensing duty may involve, in turn, significant power consumption and associated operational costs.

For example, US 2012/167616 A1 discloses a method for operating a system for the liquefaction of gas, comprising a main heat exchanger and associated closed-loop refrigeration circuit. The system further comprises a refrigerant drum connected to the main heat exchanger or forming part of the refrigeration circuit in which refrigerant can be stored during shut down of the liquefaction system, so as to avoid having to vent evaporated refrigerant. The storage drum is provided with heat transfer means (such as for example a heat transfer coil through which a secondary refrigerant is passed) for cooling and liquefying refrigerant contained within the storage drum. The main heat exchanger may also be connected to a supply line through which liquid refrigerant may be injected directly into the main heat exchanger in order to cool down the refrigerant contained therein.

Similarly, IPCOM000215855D, a document on the ip.com database, discloses a method to prevent over-pressurization of a coil-wound heat exchanger during shut down. Vaporized mixed refrigerant is withdrawn from the shell side of the coil-wound heat exchanger and sent to a vessel having a heat transfer coil through which an LNG stream can be pumped, or into which LNG may be directly injected, in order to cool down and condense the mixed refrigerant, which is then returned to the shell side of the coil-wound heat exchanger. In an alternative arrangement, the cooling and condensing of the vaporized mixed refrigerant may take place in the shell side of the coil-wound heat exchanger, by placing the heat transfer coil inside the shell or injecting LNG directly into the shell. The LNG stream can be obtained from a storage tank or from any point in the cold end of the liquefaction unit.

US 2014/075986 A1 describes a method of using the main heat exchanger and closed-loop refrigeration circuit of a liquefaction facility for separating ethane from natural gas during start up of facility, instead of for producing LNG, so as to speed up the production of ethane that is to be used as part of the mixed refrigerant during subsequent normal operation of the liquefaction facility.

US 2011/0036121 A1 describes a method of removing natural gas contaminants that have leaked into a circulating nitrogen refrigerant that is being used in the reverse Brayton cycle for liquefying natural gas. A portion of the nitrogen refrigerant is withdrawn from the cycle, liquefied in the cold end of the main heat exchanger and introduced into the top of a distillation column as reflux. The purified nitrogen vapor withdrawn from the top of the distillation column to returned to the cycle. The liquid withdrawn from the bottom of the distillation column, comprising the natural gas contaminants, may be added to the LNG stream produced by the liquefaction system.

US 2008/0115530 A1 describes a method of removing contaminants from a refrigerant stream employed in a closed-loop refrigeration cycle of an LNG facility. The refrigerant stream may be a methane refrigerant or an ethane refrigerant employed in a cascade cycle, with the contaminant comprising a heavier refrigerant (e.g. ethane or propane, respectively) that has leaked into the refrigerant from a separate closed-loop circuit of the cascade cycle. The system employs a distillation column to remove the contaminants. The contaminated refrigerant is introduced into the distillation column at an intermediate location. A vapor stream of contaminant-depleted refrigerant is withdrawn from the top of the column and returned to its closed-loop refrigeration circuit. A contaminant-enriched liquid is withdrawn from the bottom of the column and discarded.

BRIEF SUMMARY

According to a first aspect of the present invention, there is provided a method of removing refrigerant from a natural gas liquefaction system that uses a mixed refrigerant to liquefy and/or subcool natural gas, the mixed refrigerant comprising a mixture of methane and one or more heavier components, and the liquefaction system comprising a closed-loop refrigeration circuit in which the mixed refrigerant is circulated when the liquefaction system is in use, the closed-loop refrigeration circuit including a main heat exchanger through which natural gas is fed to be liquefied and/or subcooled by indirect heat exchange with the circulating mixed refrigerant, the method comprising:

(a) withdrawing vaporized mixed refrigerant from the closed-loop refrigeration circuit;

(b) introducing the vaporized mixed refrigerant into a distillation column and providing reflux to the distillation column so as to separate the vaporized mixed refrigerant into an overhead vapor enriched in methane and a bottoms liquid enriched in heavier components;

(c) withdrawing overhead vapor from the distillation column to form a methane enriched stream that is removed from the liquefaction system; and (d) reintroducing bottoms liquid from the distillation column into the closed-loop refrigeration circuit, and/or storing bottoms liquid such that it can subsequently be reintroduced into the closed-loop refrigeration circuit.

According to a second aspect of the present invention, there is provided a method of altering the rate of production of liquefied or subcooled natural gas in a natural gas liquefaction system that uses a mixed refrigerant to liquefy and/or subcool the natural gas, the liquefaction system comprising a closed-loop refrigeration circuit in which the mixed refrigerant is circulated, the mixed refrigerant comprising a mixture of methane and one or more heavier components, and the closed-loop refrigeration circuit including a main heat exchanger through which natural gas is fed to be liquefied and/or subcooled by indirect heat exchange with the circulating mixed refrigerant, the method comprising:

a first period of time during which natural gas is fed through the main heat exchanger at a first feed rate and mixed refrigerant is circulated in the closed-loop refrigeration circuit at a first circulation rate so as to produce liquefied or subcooled natural gas at a first production rate;

a second period of time during which the production of liquefied or subcooled natural gas is stopped, or the rate of production of liquefied or subcooled natural gas is reduced to a second production rate, by stopping the feed of natural gas through the main heat exchanger or reducing the feed rate thereof to a second feed rate, stopping the circulation of the mixed refrigerant in the closed-loop refrigeration circuit or reducing the circulation rate thereof to a second circulation rate, and removing refrigerant from the liquefaction system, wherein the method of removing refrigerant from the liquefaction system comprises:

(a) withdrawing vaporized mixed refrigerant from the closed-loop refrigeration circuit;

(b) introducing the vaporized mixed refrigerant into a distillation column and providing reflux to the distillation column so as to separate the vaporized mixed refrigerant into an overhead vapor enriched in methane and bottoms liquid enriched in heavier components;

(c) withdrawing overhead vapor from the distillation column to form a methane enriched stream that is removed from the liquefaction system; and (d) reintroducing bottoms liquid from the distillation column into the closed-loop refrigeration circuit, and/or storing bottoms liquid such that it can subsequently be reintroduced into the closed-loop refrigeration circuit.

According to a third aspect of the present invention, there is provided a natural gas liquefaction system that uses a mixed refrigerant, comprising a mixture of methane and one or more heavier components, to liquefy and/or subcool natural gas, the liquefaction system comprising:

a closed-loop refrigeration circuit for containing and circulating a mixed refrigerant when the liquefaction system is in use, the closed-loop refrigeration circuit including a main heat exchanger through which natural gas can be fed to be liquefied and/or subcooled by indirect heat exchange with the circulating mixed refrigerant;

a distillation column for receiving vaporized mixed refrigerant from the closed-loop refrigeration circuit and operable to separate the vaporized mixed refrigerant into an overhead vapor enriched in methane and a bottoms liquid enriched in heavier components of the mixed refrigerant;

means for providing reflux to the distillation column;

conduits for transferring vaporized mixed refrigerant from the closed-loop refrigeration circuit to the distillation column, for withdrawing from the distillation column and removing from the liquefaction system a methane enriched stream formed from the overhead vapor, and for reintroducing bottoms liquid from the distillation column into the closed-loop refrigeration circuit.

DETAILED DESCRIPTION

Figure 1:
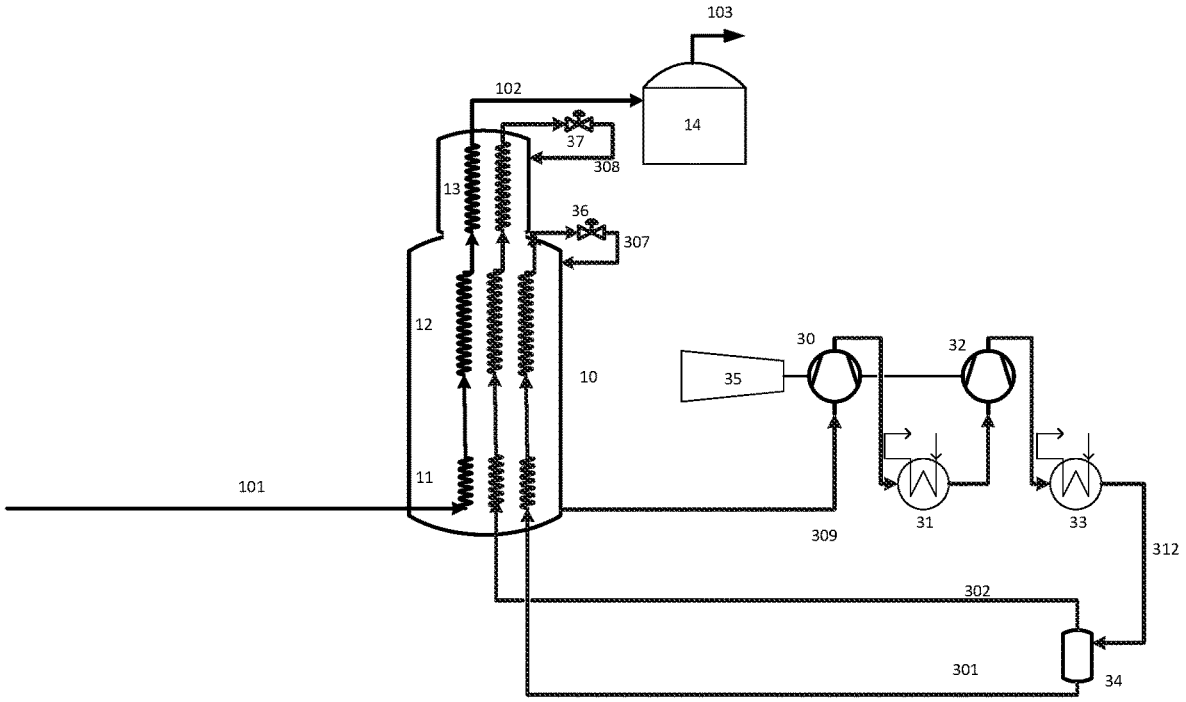
FIG. 1 is a schematic flow diagram depicting a natural gas liquefaction system according to an embodiment of the invention operating during a first period of time, in which it is operating under normal conditions during which liquefied and subcooled natural gas is being produced at a first, or normal production rate.

Mixed refrigerants are a valuable commodity in a natural gas liquefaction plant. Typically, they can be extracted and manufactured from the natural gas feed itself, using a natural gas liquids (NGL) recovery system either in integration with the liquefaction or prior to liquefaction. However, while components of the mixed refrigerant such as methane can easily be obtained in this way, some other components are far more time consuming and difficult to isolate (such as for example ethane/ethylene and higher hydrocarbons that are present only in small amounts in the natural gas) or may not be possible to obtain in this way at all (for example HFCs, which are not present in the natural gas at all). In practice, therefore, the heavier components of the mixed refrigerant may have to be imported into the facility, at significant expense. Consequently, the loss of such refrigerants has a significant financial impact.

Equally, however, under upset conditions, such as during shut down or turn down of the liquefaction system, refrigerant may have to be removed from the closed-loop refrigeration circuit for reasons discussed above. Mixed refrigerant removed from the closed-loop refrigeration circuit may simply be vented or flared, but then this refrigerant, and in particular the heavier components thereof, has been lost. Alternatively, the removed mixed refrigerant may be stored in an at least partially condensed state, but then the cooling duty required for this is likely to involve significant power consumption and associated operational costs, as also discussed above.

The methods and systems in accordance with the first, second, and third aspects of present invention, as described above, address these problems by separating the vaporized mixed refrigerant initially removed from the closed-loop refrigerant circuit in a distillation column into a methane enriched fraction (that collects as overhead vapor in the distillation column) and a heavier component enriched fraction (that collects as bottoms liquid in the distillation column), allowing a methane enriched stream to be rejected from the liquefaction system and a stream enriched in the heavier components to be returned to the closed-loop refrigeration circuit and/or stored for subsequent reintroduction into the closed-loop refrigeration circuit.

In this way, the heavier components of the mixed refrigerant (such as for example ethane/ethylene and higher hydrocarbons) can largely be retained, thereby avoiding the difficulties and/or costs of having to replace these components in the mixed refrigerant once the reasons for having to remove the refrigerant have passed and normal operation of the liquefaction system can be restored. At the same time, by removing a methane enriched stream, formed from the overhead vapor, from the distillation column and from the liquefaction system (either by simply flaring this stream or by putting it to some other use), the difficulties and costs associated with storing the methane until normal operations are restored are also avoided. As noted above, since methane is present as the main component of the natural gas that is available on site, replacing the methane in the refrigerant is a relatively easy and quick process. Likewise, where nitrogen is also present in the mixed refrigerant, and thus also removed as part of the methane enriched stream, this is usually also relatively easy to replace, since natural gas liquefaction systems typically require nitrogen for inerting purposes and so often have nitrogen generation facilities on site. Furthermore, as methane, nitrogen (if present) and any other light components present in the mixed refrigerant will have higher vapor pressures than the heavier components of the mixed refrigerant, they inherently require colder storage temperatures (or higher storage pressures), which also makes the rejection rather than storage of these components beneficial.

The articles "a" and "an", as used herein and unless otherwise indicated, mean one or more when applied to any feature in embodiments of the present invention described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used.

As used herein, the term "natural gas" encompasses also synthetic and substitute natural gases. The major component of natural gas is methane (which typically comprises at least 85 mole %, more often at least 90 mole %, and on average about 95 mole % of the feed stream). Other typically components of the natural gas include nitrogen, one or more other hydrocarbons, and/or other components such as helium, hydrogen, carbon dioxide and/or other acid gases, and mercury. However, prior to being subjected to liquefaction, components such as moisture, acid gases, mercury and natural gas liquids (NGL) a removed from the feed, down to the levels necessary to avoid freezing or other operational problems in the heat exchanger in which liquefaction takes place.

As used herein, the term "mixed refrigerant" refers, unless otherwise indicated, to a composition comprising methane and one or more heavier components. It may also further comprise one or more additional light components. The term "heavier component" refers to components of the mixed refrigerant that have a lower volatility (i.e. higher boiling point) than methane. The term "light component" refers to components having the same or a higher volatility (i.e. the same or a lower boiling point) than methane. Typical heavier components include heavier hydrocarbons, such as but not limited to ethane/ethylene, propane, butanes and pentanes. Additional or alternative heavier components may include hydrofluorocarbons (HFCs). Nitrogen is often also present in the mixed refrigerant, and constitutes an exemplary additional light component. When present, nitrogen is separated by the distillation column with the methane, such that both the overhead vapor from the distillation column and methane enriched stream that is removed from the liquefaction system are also enriched in nitrogen. In a variant, the methods and systems of the present invention could also be applied to methods and systems where the mixed refrigerant does not contain methane but contains instead nitrogen and one or more heavier components (such as for example an N2/HFC mixture), the overhead from the distillation column being enriched in nitrogen and a nitrogen enriched stream being removed from the liquefaction system. However, this is not preferred.

The liquefaction system in the methods and systems in accordance with the present invention can employ any suitable refrigerant cycle for liquefying, and optionally subcooling, natural gas, such as but not limited to the single mixed refrigerant (SMR) cycle, propane-precooled mixed refrigerant (C3MR) cycle, dual mixed refrigerant (DMR) cycle and C3MR-Nitrogen hybrid (such as AP-X™) cycle. The closed-loop refrigeration circuit, in which the mixed refrigerant is circulated, can be used to both liquefy and subcool the natural gas, or alternatively it can be used just to liquefy the natural gas, or to subcool natural gas that has already been liquefied by another part of the liquefaction system. In systems where more than one mixed refrigerant-containing closed-loop circuit is present, the methods of removing refrigerant in accordance with the present invention can be used in connection with the mixed refrigerant present in just one of the closed-loop circuits, or can be used in connection with the mixed refrigerants present in more than one, or all, of the closed-loop circuits.

As used herein, the term "main heat exchanger" refers to the part of the closed-loop refrigeration circuit through which natural gas is passed to be liquefied and/or subcooled by indirect heat exchange with the circulating mixed refrigerant. The main heat exchanger may be composed of one or more cooling sections arranged in series and/or in parallel. Each such section may constitute a separate unit having its own housing, but equally sections may be combined into a single unit sharing a common housing. The main heat exchanger may be of any suitable type, such as but not limited to a heat exchanger of the shell and tube, coil-wound, or plate and fin type, though it is preferred that the heat exchanger is a coil-wound heat exchanger. In such exchangers, each cooling section will typically comprise its own tube bundle (where the exchanger is of the shell and tube or coil-wound type) or plate and fin bundle (where the unit is of the plate and fin type). As used herein, the "warm end" and "cold end" of the main heat exchanger are relative terms, referring to the ends of the main heat exchanger that are of the highest and lowest temperature (respectively), and are not intended to imply any particular temperature ranges, unless otherwise indicated. The phrase "an intermediate location" of the main heat exchanger refers to a location between the warm and cold ends, typically between two cooling sections that are in series.

The vaporized mixed refrigerant that is withdrawn from the closed-loop refrigerant circuit is preferably withdrawn from a cold end of and/or from an intermediate location of the main heat exchanger. Where the main heat exchanger is a coil-wound heat exchanger, the vaporized mixed refrigerant is preferably withdrawn from the shell-side of the coil-wound heat exchanger.

As used herein, the term "distillation column" refers to a column (or set of columns) containing one or more separation stages composed of devices, such as packing or a tray, that increase contact and thus enhance mass transfer between the upward rising vapor and downward flowing liquid flowing inside the column. In this way, the concentration of methane and any other light components (such as nitrogen when present) is increased in the rising vapor that collects as overhead vapor at the top of the column, and the concentration of heavier components is increased in the bottoms liquid that collects at the bottom of the column. The "top" of the distillation column refers to the part of the column at or above the top most separation stage. The "bottom" of the column refers to the part of the column at or below the bottom most separation stage.

The vaporized mixed refrigerant withdrawn from the closed-loop refrigeration circuit is preferably introduced into the bottom of the distillation column. Reflux to the distillation column, i.e. downward flowing liquid inside that distillation column, can be generated by any suitable means. For example, reflux may be provided a reflux stream of condensate obtained by condensing at least a portion of the overhead vapor in an overhead condenser by indirect heat exchange with a coolant. Alternatively or additionally, reflux may be provided by a reflux stream of liquid that is introduced into the top of the distillation column. The coolant and/or the reflux stream of liquid can, for example, comprise a stream of liquefied natural gas taken from liquefied natural gas that is being or has been produced by the liquefaction system.

As used herein, reference to the overhead vapor, or the stream removed from the liquefaction system, being "enriched" in a component (such as being enriched in methane, nitrogen and/or another light component) means that said overhead vapor or stream has a higher concentration (mole %) of said component than the vaporized mixed refrigerant that is withdrawn from the closed-loop refrigeration circuit and introduced into the distillation column. Similarly, reference to the bottoms liquid being "enriched" in a heavier component means that said bottoms liquid has a higher concentration (mole %) of said component than the vaporized mixed refrigerant that is withdrawn from the closed-loop refrigeration circuit and introduced into the distillation column.

The methane enriched stream that is removed from the liquefaction system can be disposed of or put to any suitable purpose. It may, for example, be flared, used as fuel (for example in order to generate power, electricity, or useful heat), added to a natural gas feed that is to be liquefied by the liquefaction system, and or exported (for example via a pipe-line) to an off-site location.

Where some or all of the bottoms liquid from the distillation column is stored prior to being reintroduced into the closed-loop refrigeration circuit, bottoms liquid can be stored in the bottom of the distillation column and/or can be withdrawn from the distillation column and stored in a separate storage vessel. In preferred embodiments, all of the bottoms liquid that is produced by the distillation column is reintroduced into the closed-loop refrigeration circuit (either directly and/or after temporary storage).

The method of removing refrigerant according to the first aspect of the present invention is preferably carried out in response to a shutdown of or turn-down in the rate of natural gas liquefaction and/or subcooling by the liquefaction system. Alternatively, the method could be carried out in response to other occurrences or upset situations, such as for example where a leak is detected or discovered in the main heat exchanger.

In the method of altering production rate according to the second aspect of the present invention, the first period of time may, for example, represent normal operation of the system, with the first production rate corresponding to the normal rate of production of liquefied or subcooled natural gas, and the second period of time representing a period of turn-down or shutdown when the rate of production of liquefied or subcooled natural gas is reduced (to the second, or turn-down, production rate) or is stopped altogether.

The method of altering production rate according to the second aspect of the present invention may further comprise a further, or third, period of time after the second period of time, during which the rate of production of liquefied or subcooled natural gas is increased to a third production rate, by increasing the feed of natural gas through the main heat exchanger to a third feed rate, adding refrigerant to the liquefaction system, and increasing the circulation of the mixed refrigerant to a third circulation rate. The step of adding refrigerant to the liquefaction system may comprise introducing methane into the closed-loop refrigeration circuit. Some or all of this methane may be obtained from the natural gas supply that provides natural gas for liquefaction in the liquefaction system. If bottoms liquid has not already been reintroduced into the closed-loop refrigeration circuit in step (d) of the second time period (or if some bottoms liquid has been stored, and heavier components still need to be reintroduced into the closed-loop refrigeration circuit) then the step of adding refrigerant to the liquefaction system may also comprise reintroducing stored bottoms liquid into the closed-loop refrigeration circuit. The third production rate of liquefied or subcooled natural gas, third feed rate of natural gas and third circulation rate of mixed refrigerant are preferably the same as or less than the first production rate, first feed rate and first circulation rate, respectively. In particular, the third production rate, third feed rate and third circulation rate may be the same as the first production rate, first feed rate and first circulation rate, respectively, with the third period of time representing the restoration of the liquefaction system to normal operation.

The natural gas liquefaction system in accordance with the third aspect of the present invention is, in particular, suitable for carrying out methods in accordance with the first and/or second aspects of the invention.

Preferred aspects of the present invention include the following aspects, numbered #1 to #29:

#1. A method of removing refrigerant from a natural gas liquefaction system that uses a mixed refrigerant to liquefy and/or subcool natural gas, the mixed refrigerant comprising a mixture of methane and one or more heavier components, and the liquefaction system comprising a closed-loop refrigeration circuit in which the mixed refrigerant is circulated when the liquefaction system is in use, the closed-loop refrigeration circuit including a main heat exchanger through which natural gas is fed to be liquefied and/or subcooled by indirect heat exchange with the circulating mixed refrigerant, the method comprising:

(a) withdrawing vaporized mixed refrigerant from the closed-loop refrigeration circuit;

(b) introducing the vaporized mixed refrigerant into a distillation column and providing reflux to the distillation column so as to separate the vaporized mixed refrigerant into an overhead vapor enriched in methane and a bottoms liquid enriched in heavier components;

(c) withdrawing overhead vapor from the distillation column to form a methane enriched stream that is removed from the liquefaction system; and (d) reintroducing bottoms liquid from the distillation column into the closed-loop refrigeration circuit, and/or storing bottoms liquid such that it can subsequently be reintroduced into the closed-loop refrigeration circuit.

#2. The method of Aspect #1, wherein the heavier components comprise one or more heavier hydrocarbons.

#3. The method of Aspect #1 or #2, wherein the mixed refrigerant further comprises nitrogen, the overhead vapor in step (b) is enriched in nitrogen and methane, and the methane enriched stream in step (c) is a nitrogen and methane enriched stream.

#4. The method of any one of Aspects #1 to #3, wherein in step (b) reflux to the distillation column is provided by a reflux stream of condensate obtained by cooling and condensing at least a portion of the overhead vapor in an overhead condenser by indirect heat exchange with a coolant.

#5. The method of Aspect #4, wherein the coolant comprises a liquefied natural gas stream taken from liquefied natural gas that is being or has been produced by the liquefaction system.

#6. The method of any one of Aspects #1 to #5, wherein in step (b) reflux to the distillation column is provided by a reflux stream of liquid introduced into the top of the distillation column.

#7. The method of Aspect #6, wherein the reflux stream of liquid comprises a stream of liquefied natural gas taken from liquefied natural gas that is being or has been produced by the liquefaction system.

#8. The method of any one of Aspects #1 to #7, wherein the methane enriched stream formed in step (c) is flared, used as fuel and/or added to a natural gas feed that is to be liquefied by the liquefaction system.

#9. The method of any one of Aspects #1 to #8, wherein in step (d) the bottoms liquid is stored in the bottom of the distillation column and/or is withdrawn from the distillation column and stored in a separate storage vessel prior to being reintroduced into the closed-loop refrigeration circuit.

#10. The method of any one of Aspects #1 to #9, wherein in step (a) the vaporized mixed refrigerant is withdrawn from a cold end of and/or from an intermediate location of the main heat exchanger.

#11. The method of any one of Aspects #1 to #10, wherein the main heat exchanger is a coil-wound heat exchanger.

#12. The method of Aspect #11, wherein in step (a) the vaporized mixed refrigerant is withdrawn from the shell-side of the coil-wound heat exchanger.

#13. The method of any one of Aspects #1 to #12, wherein the method is carried out in response to a shutdown of or turn-down in the rate of natural gas liquefaction and/or subcooling by the liquefaction system.

#14. A method of altering the rate of production of liquefied or subcooled natural gas in a natural gas liquefaction system that uses a mixed refrigerant to liquefy and/or subcool the natural gas, the liquefaction system comprising a closed-loop refrigeration circuit in which the mixed refrigerant is circulated, the mixed refrigerant comprising a mixture of methane and one or more heavier components, and the closed-loop refrigeration circuit including a main heat exchanger through which natural gas is fed to be liquefied and/or subcooled by indirect heat exchange with the circulating mixed refrigerant, the method comprising:

a first period of time during which natural gas is fed through the main heat exchanger at a first feed rate and mixed refrigerant is circulated in the closed-loop refrigeration circuit at a first circulation rate so as to produce liquefied or subcooled natural gas at a first production rate;

a second period of time during which the production of liquefied or subcooled natural gas is stopped, or the rate of production of liquefied or subcooled natural gas is reduced to a second production rate, by stopping the feed of natural gas through the main heat exchanger or reducing the feed rate thereof to a second feed rate, stopping the circulation of the mixed refrigerant in the closed-loop refrigeration circuit or reducing the circulation rate thereof to a second circulation rate, and removing refrigerant from the liquefaction system, wherein the method of removing refrigerant from the liquefaction system comprises:

(a) withdrawing vaporized mixed refrigerant from the closed-loop refrigeration circuit;

(b) introducing the vaporized mixed refrigerant into a distillation column and providing reflux to the distillation column so as to separate the vaporized mixed refrigerant into an overhead vapor enriched in methane and bottoms liquid enriched in heavier components;

(c) withdrawing overhead vapor from the distillation column to form a methane enriched stream that is removed from the liquefaction system; and (d) reintroducing bottoms liquid from the distillation column into the closed-loop refrigeration circuit, and/or storing bottoms liquid such that it can subsequently be reintroduced into the closed-loop refrigeration circuit.

#15. The method of Aspect #14, wherein the method further comprises, after the second period of time:

a third period of time during which the rate of production of liquefied or subcooled natural gas is increased to a third production rate, by increasing the feed of natural gas through the main heat exchanger to a third feed rate, adding refrigerant to the liquefaction system, and increasing the circulation of the mixed refrigerant to a third circulation rate, wherein the step of adding refrigerant to the liquefaction system comprises introducing methane into the closed-loop refrigeration circuit and, if bottoms liquid has not already been reintroduced into the closed-loop refrigeration circuit in step (d) of the second time period, reintroducing stored bottoms liquid into the closed-loop refrigeration circuit.

#16. The method of Aspect #15, wherein the third production rate of liquefied or subcooled natural gas, third feed rate of natural gas and third circulation rate of mixed refrigerant are the same as or less than the first production rate, first feed rate and first circulation rate, respectively.

#17. The method of Aspect #15 or #16, wherein the methane that is introduced into the closed-loop refrigeration circuit is obtained from the natural gas supply that provides natural gas for liquefaction in the liquefaction system.

#18. The method of any one of Aspects #15 to #17, wherein in the second period of time the method of removing refrigerant from the liquefaction system is as further defined in any one of Aspects #2 to #12.

#19. A natural gas liquefaction system that uses a mixed refrigerant, comprising a mixture of methane and one or more heavier components, to liquefy and/or subcool natural gas, the liquefaction system comprising:

a closed-loop refrigeration circuit for containing and circulating a mixed refrigerant when the liquefaction system is in use, the closed-loop refrigeration circuit including a main heat exchanger through which natural gas can be fed to be liquefied and/or subcooled by indirect heat exchange with the circulating mixed refrigerant;

a distillation column for receiving vaporized mixed refrigerant from the closed-loop refrigeration circuit and operable to separate the vaporized mixed refrigerant into an overhead vapor enriched in methane and a bottoms liquid enriched in heavier components of the mixed refrigerant;

means for providing reflux to the distillation column;

conduits for transferring vaporized mixed refrigerant from the closed-loop refrigeration circuit to the distillation column, for withdrawing from the distillation column and removing from the liquefaction system a methane enriched stream formed from the overhead vapor, and for reintroducing bottoms liquid from the distillation column into the closed-loop refrigeration circuit.

#20. A system according to Aspect #19, wherein the apparatus further comprises a storage device for storing bottoms liquid prior to the reintroduction thereof into the closed-loop refrigeration circuit.

#21. A system according to Aspect #20, wherein the storage device for storing the bottoms liquid comprises a bottom section of the distillation column and/or a separate storage vessel.

#22. A system according to any one of Aspects #19 to #21, wherein the means for providing reflux to the distillation column comprise an overhead condenser for cooling and condensing at least a portion of the overhead vapor via indirect heat exchange with a coolant so as to provide a reflux stream of condensate.

#23. A system according to Aspect #22, wherein the coolant comprises a liquefied natural gas stream and the apparatus further comprises a conduit for delivering a portion of the liquefied natural gas produced by the liquefaction system to the overhead condenser

#24. A system according to any one of Aspects #19 to #23, wherein the means for providing reflux to the distillation column comprise a conduit for introducing a reflux stream of liquid into the top of the distillation column.

#25. A system according to Aspect #24, wherein the reflux stream of liquid comprises liquefied natural gas and the conduit for introducing the reflux stream delivers a portion of the liquefied natural gas produced by the liquefaction system into the top of the distillation column.

#26. A system according to any one of Aspects #19 to #25, wherein the conduit for withdrawing and removing the methane enriched stream delivers the stream to a device for flaring the stream, to a device for combusting the stream to generate power or electricity, and/or to a natural gas feed conduit for feeding natural gas to the liquefaction system for liquefaction.

#27. A system according to any one of Aspects #19 to #26, wherein the conduit for transferring vaporized mixed refrigerant from the closed-loop refrigeration circuit to the distillation column withdraws vaporized mixed refrigerant from a cold end of and/or from an intermediate location of the main heat exchanger.

#28. A system according to any one of Aspects #19 to #27, wherein the main heat exchanger is a coil-wound heat exchanger.

#29. A system according to Aspect #28, wherein the conduit for transferring vaporized mixed refrigerant from the closed-loop refrigeration circuit to the distillation column withdraws vaporized mixed refrigerant from the shell-side of the coil-wound heat exchanger heat exchanger.

Solely by way of example, certain preferred embodiment of the invention will now be described with reference to FIGS. 1 to 6. In these Figures, where a feature is common to more than one Figure that feature has been assigned the same reference numeral in each Figure, for clarity and brevity.

In the embodiments illustrated in FIGS. 1 to 6, the natural gas liquefaction system has a main heat exchanger that is of the coil-wound type and that comprises a single unit in which three separate tube bundles, through which the natural gas is passed to be both liquefied and subcooled, are housed in the same shell. However, it should be understood that more or fewer tube bundles could be used, and that the bundles (where more than one is used) could instead be housed in separate shells so that the main heat exchanger would instead comprise a series of units. Equally, the main heat exchanger need not be of the coil-wound type, and could instead be another type of heat exchanger, such as but not limited to another type of shell and tube heat exchanger or a heat exchanger of the plate and fin type.

Also, in the embodiments illustrated in FIGS. 1 to 6, the natural gas liquefaction system employs a C3MR cycle or a DMR cycle to both liquefy and subcool the natural gas, the closed-loop refrigeration circuit, containing mixed-refrigerant, that is used to liquefy and subcool the natural gas being arranged and depicted accordingly (with the propane or mixed refrigerant pre-cooling section not being shown, for simplicity). Again, however, other types of refrigerant cycle could be used, such as but not limited to a SMR cycle or C3MR-Nitrogen hybrid. In such alternative cycles the mixed refrigerant might be used only to liquefy or subcool the natural gas, and the closed-loop refrigeration circuit in which the mixed refrigerant is circulated would then be reconfigured accordingly.

The mixed-refrigerant used in these embodiments comprises methane and one or more heavier components. Preferably, the heavier components comprise one or more heavier hydrocarbons, and nitrogen is also present as an additional light component. In particular, a mixed refrigerant comprising a mixture of nitrogen, methane, ethane/ethylene, propane, butanes and pentanes is generally preferred.

Figure 2:
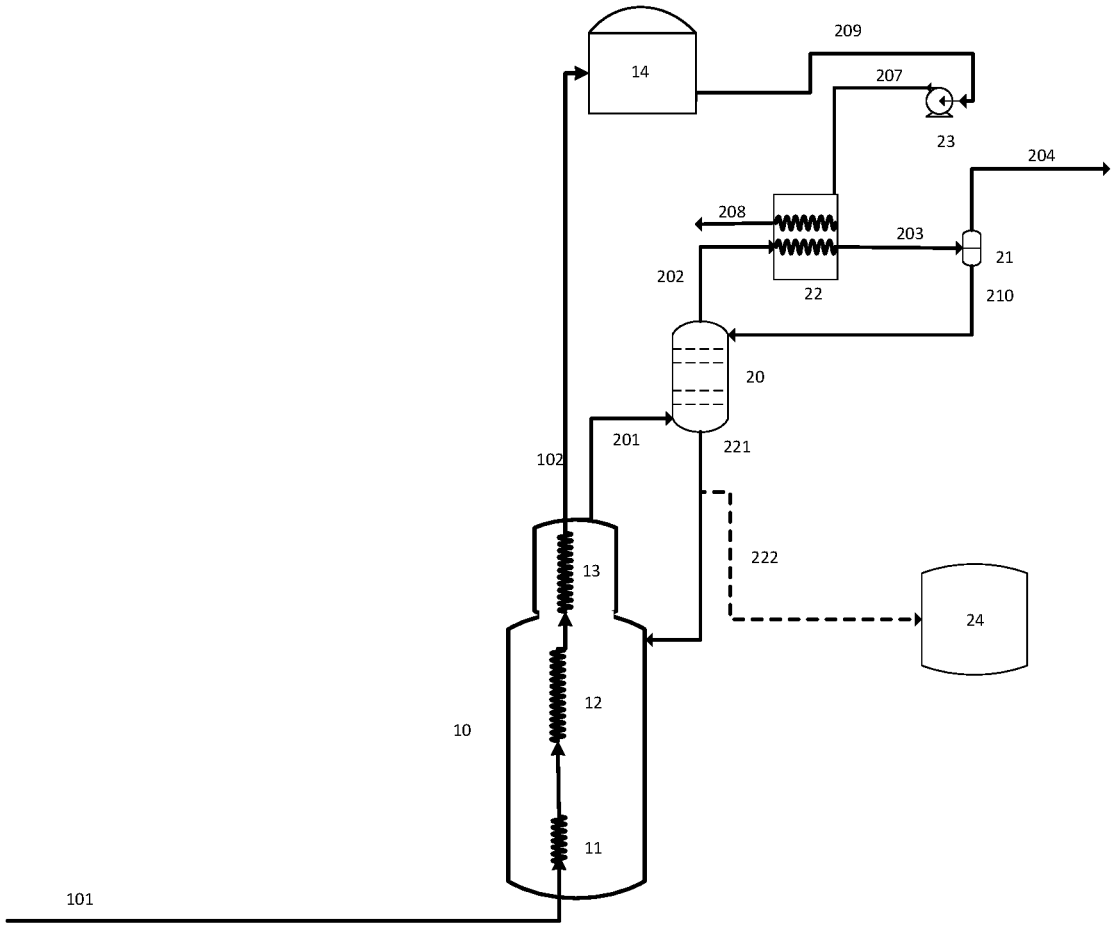
FIG. 2 is a schematic flow diagram depicting the natural gas liquefaction system now operating during a second period of time, in which it is now operating under turn-down or shut down conditions during which the production of liquefied and subcooled natural gas has been reduced or stomped, and in which refrigerant is now being removed from the natural gas liquefaction system.
Figure 3:
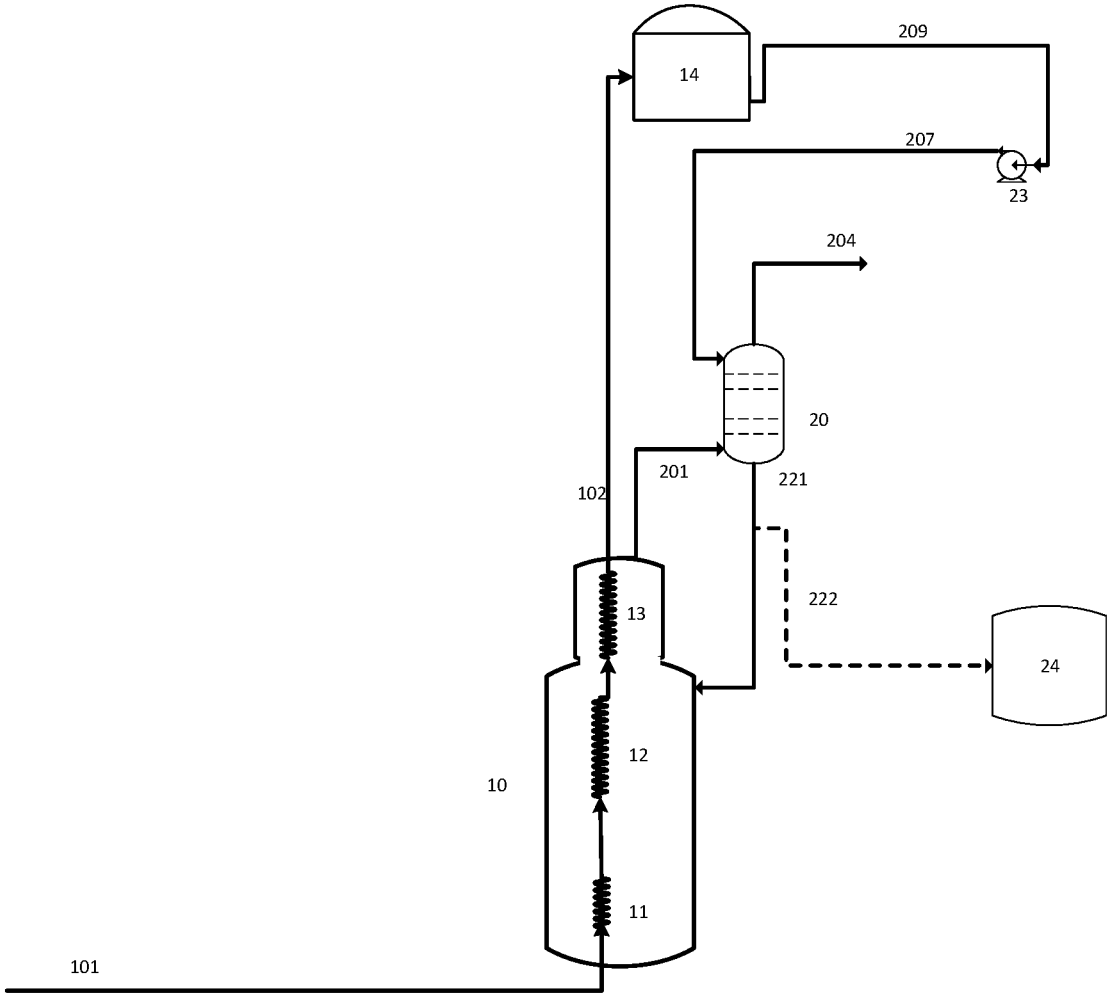
FIG. 3 is a schematic flow diagram depicting a natural gas liquefaction system according to another embodiment of the invention, also operating during a second period of time, in which it is operating under turn-down or shut down conditions during which the production of liquefied and subcooled natural gas has been reduced or stomped, and in which refrigerant is now being removed from the natural gas liquefaction system.
Figure 4:
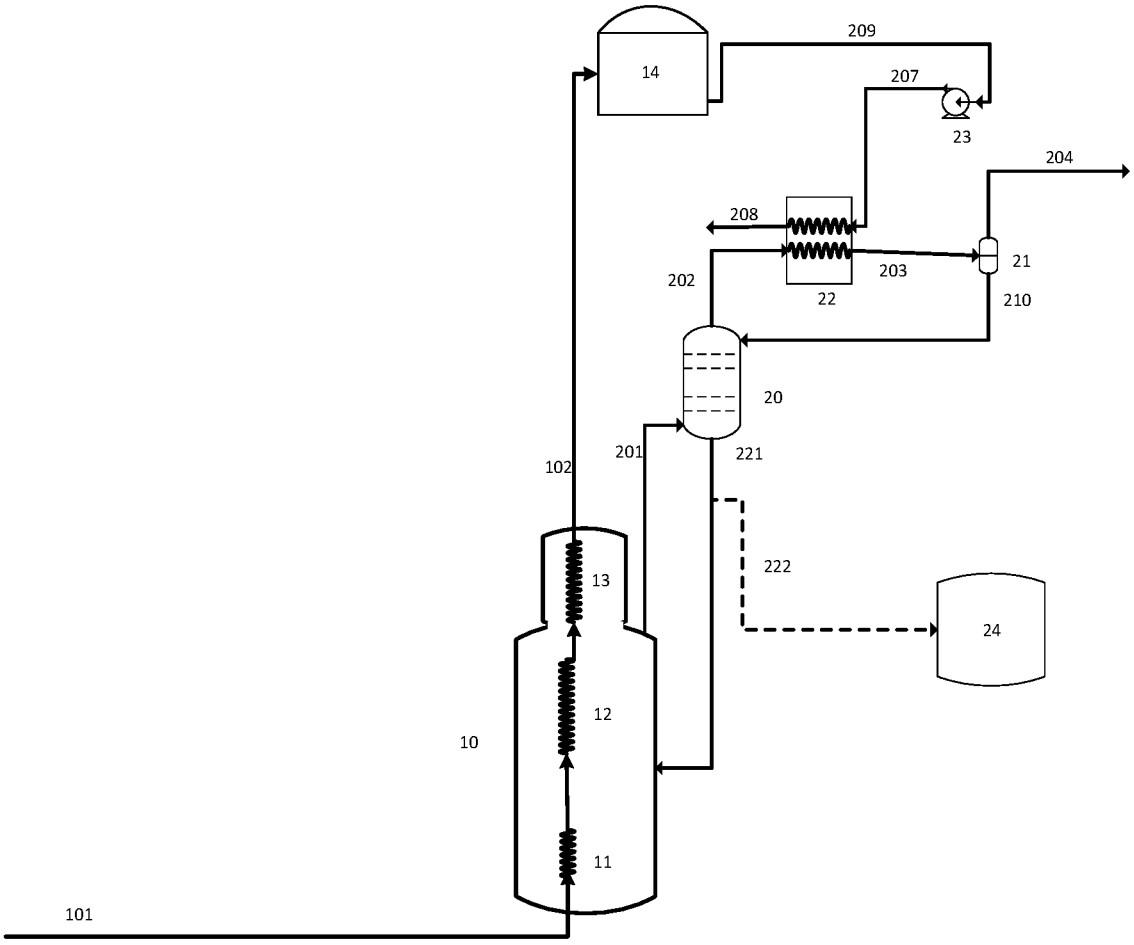
FIG. 4 is a schematic flow diagram depicting a natural gas liquefaction system according to another embodiment of the invention, also operating during a second period of time, in which it is operating under turn-down or shut down conditions during which the production of liquefied and subcooled natural gas has been reduced or stomped, and in which refrigerant is now being removed from the natural gas liquefaction system.

Referring to FIG. 1, a natural gas liquefaction system according to an embodiment of the invention is shown operating during a first period of time, in which it is operating under normal conditions, during which natural gas is fed through the main heat exchanger at a first feed rate and mixed refrigerant is circulated in the closed-loop refrigeration circuit at a first circulation rate so as to produce liquefied and subcooled natural gas at a first, or normal production rate. For simplicity, features of the liquefaction system that are used for removing refrigerant from the liquefaction system under subsequent turn-down or shut down conditions, and that will be described in further detail below with reference to FIGS. 2 to 4, are not depicted in FIG. 1.

The natural gas liquefaction system comprises a closed loop refrigeration circuit that, in this instance, comprises main heat exchanger 10, refrigerant compressors 30 and 32, refrigerant coolers 31 and 33, phase separator 34, and expansion devices 36 and 37. The main heat exchanger 10 is, as noted above, a coil-wound heat exchanger that comprises three helically wound tube bundles 11, 12, 13, housed in a single pressurized shell (typically made of aluminium or stainless steel). Each tube bundle may consist of several thousand tubes, wrapped in a helical fashion around a central mandrel, and connected to tube-sheets located above and below the bundle.

Natural gas feed stream 101, which in this embodiment has already been pre-cooled in a pre-cooling section (not shown) of the liquefaction system that uses propane or mixed refrigerant in a different closed-loop circuit to pre-cool the natural gas, enters at the warm end of the coil-wound heat exchanger 10 and is liquefied and subcooled as it flows through the warm 11, middle 12 and cold 13 tubes bundles, before exiting the cold end of the coil-wound heat exchanger as subcooled, liquefied natural gas (LNG) stream 102. The natural gas feed stream 101 will also have been pre-treated as and if necessary to remove any moisture, acid gases, mercury and natural gas liquids (NGLs) down to the levels necessary to avoid freezing or other operational problems in the coil-wound heat exchanger 10. The subcooled, liquefied natural gas (LNG) stream 102 exiting the coil-wound heat exchanger may be sent directly to a pipeline for delivery off-site (not shown), and/or may be sent to an LNG storage tank 14 from which LNG 103 can be withdrawn as and when required.

The natural gas is cooled, liquefied and subcooled in the coil-wound heat exchanger by indirect heat exchange with cold vaporized or vaporizing mixed refrigerant flowing through the shell-side of the coil-wound heat exchanger, from the cold end to the warm end, over the outside of the tubes. Typically there is, located at the top of each bundle within the shell, a distributor assembly that distributes the shell-side refrigerant across the top of the bundle.

Warmed, vaporized mixed refrigerant 309 exiting the warm end of the coil-wound heat exchanger is compressed in refrigerant compressors 30 and 32 and cooled in inter- and after-coolers 31 and 33 (typically against water or another ambient temperate cooling medium) to form a stream of compressed, partially condensed mixed refrigerant 312. This is then separated in phase separator 34 into a liquid stream of mixed refrigerant 301 and a vapor stream of mixed refrigerant 302. In the illustrated embodiment, the refrigerant compressors 30 and 32 are driven by a common motor 35.

The liquid stream of mixed refrigerant 301 is passed through the warm 11 and middle 12 tube bundles of the coil wound heat exchanger, separately from the natural gas feed stream 101, so as to also be cooled therein, and is then expanded in expansion device 36 to form a stream of cold refrigerant 307, typically a temperature of about −60 to −120 C, that is re-introduced into shell-side of the coil-wound heat exchanger 10, at an intermediate location between the cold 13 and middle 12 tube bundles, to provide part of the aforementioned cold vaporized or vaporizing mixed refrigerant flowing through the shell-side of the coil-wound heat exchanger.

The vapor stream of mixed refrigerant 302 is passed through the warm 11, middle 12 and cold 13 tube bundles of the coil wound heat exchanger, separately from the natural gas feed stream 101, so as to also be cooled and at least partially condensed therein, and is then expanded in expansion device 37 to form a stream of cold refrigerant 308, typically at a temperature of about −120 to −150 C, that is re-introduced into shell-side of the coil-wound heat exchanger 10 at the cold end of the coil-wound heat exchanger, to provide the remainder of the aforementioned cold vaporized or vaporizing mixed refrigerant flowing through the shell-side of the coil-wound heat exchanger.

As will be recognized, the terms 'warm' and 'cold' in above context refer only to the relative temperatures of the streams or parts in question and, unless otherwise indicated, do not imply any particular temperature ranges. In the embodiment illustrated in FIG. 1, expansion devices 36 and 37 are Joule-Thomson (J-T) valves, but equally any other device suitable for expanding the mixed-refrigerant streams could be used.

Referring to FIG. 2, the natural gas liquefaction system is now shown operating during a second period of time, in which it is now operating under turn-down or shut down conditions, during which the production of liquefied and subcooled natural gas has been reduced or stomped and in which refrigerant is now being removed from the natural gas liquefaction system.

Where the liquefaction system is operating under turn-down conditions then natural gas feed stream 101 is still being passed through the coil-wound heat exchanger 10 to produce subcooled LNG stream 102, but the feed rate of the natural gas (i.e. flow rate the natural gas feed stream 101) and the production rate of LNG (i.e. the flow rate of subcooled, LNG stream 102) is reduced as compared to the feed and production rates in FIG. 1. Likewise the circulation rate of the mixed-refrigerant in the closed-loop refrigeration circuit (i.e. the flow rate of the mixed-refrigerant around the circuit and, in particular, through main heat exchanger 10) is reduced, as compared to the circulation rate in FIG. 1, so as to reduce the amount of cooling duty provided by the refrigerant to match the reduced production rate of LNG. Where the liquefaction system is operating under shutdown conditions, the feed of natural gas, circulation of the mixed refrigerant and (of course) production of subcooled LNG have all been stopped.

A stream of vaporized mixed refrigerant 201 is withdrawn from the closed-loop refrigeration circuit by being withdrawn from the shell-side of the coil-wound heat exchanger 10 at the cold-end thereof, and is introduced into the bottom of a distillation column 20 containing multiple separation stages, composed for example of packing or trays, that serve to separate the vaporized mixed refrigerant into an overhead vapor that accumulates at the top of the distillation column and a bottoms liquid that accumulates at the bottom of the distillation column. The overhead vapor is enriched, relative to the mixed-refrigerant that is fed into the column, in methane and any other light components of the mixed refrigerant. For example, when nitrogen is present in the mixed refrigerant, the overhead vapor is also enriched in nitrogen. The bottoms liquid is enriched, relative to the mixed refrigerant that is fed into the column, in components of the mixed refrigerant that are heavier than methane. Exemplary heavier components include, as previously noted, ethane/ethylene, propane, butanes and pentanes, for example. The operating pressure of the distillation column is typically less than 150 psig (less than 100 atm).

Reflux to the distillation column is generated in this embodiment by cooling and condensing at least a portion of the overhead vapor in an overhead condenser 22 by indirect heat exchange with a coolant 207. The overhead condenser 22 may be integrated with or part of the top or the distillation column 20, or it may (as illustrated in FIG. 2) be a separate unit to which overhead vapor is transferred.

Overhead vapor 202 from the distillation column 20 passes through the condenser 22 and is, in this embodiment, partially condensed to form a mixed phase stream 203. The mixed phase stream 203 is then separated, in phase separator 21, into a liquid condensate that is returned to the top of the distillation column as reflux stream 210, and a remaining, methane enriched, vapor portion that is removed from the liquefaction system as methane-enriched stream 204. In an alternative embodiment (not shown), the overhead vapor 202 could be fully condensed in the overhead condenser, and the condensed overhead then divided into two streams, one of which is returned to the top of the distillation column as reflux stream 210 and the other of which forms the (in this case liquid) methane-enriched stream 204 withdrawn from the liquefaction system.

This would allow phase separator 21 to be dispensed with, but would also require increased cooling duty for the overhead condenser, and so is not generally preferred.

The methane-enriched stream 204 withdrawn from the liquefaction system is preferably largely free of heavier components. For example, where the heavier components comprise ethane and higher hydrocarbons, it typically contains less than about 1% of these components. Where nitrogen is also present in the mixed refrigerant, stream 204 is enriched in both methane and nitrogen. The nitrogen to methane ratio in the stream will depend on their ratio in the vaporized mixed refrigerant withdrawn from the closed-loop refrigeration circuit, but will typically range from about 5-40 mole % $N_2$. The methane enriched stream 204 may be disposed of by being sent to and flared in a flare stack (not shown) or other suitable device for flaring the stream, but preferably it is used as a fuel, sent to an external pipeline or external natural gas use, or is added to the natural gas feed stream 101 so as to provide additional feed for generating additional subcooled LNG. If the methane enriched stream 204 is used as fuel it may, for example, be combusted in a gas-turbine (not shown) or other form of combustion device in order to generate power for onsite use (such as by the motor 35 driving refrigerant condensers 30 and 32), to generate electricity for export, and/or to provide process heating in the plant such as in the acid gas removal unit.

The Bottoms liquid 221/222 from the distillation column 20 is reintroduced into the closed-loop refrigeration circuit and/or is stored so that it can be subsequently reintroduced into the closed-loop refrigeration circuit. The bottoms liquid is, as noted above, enriched in the heavier components, and preferably consists mainly of these heavier components. Preferably it contains less than 10 mole % methane and any other light components (for example, less than 10 mole % $CH_4$+$N_2$). It may be reintroduced into the closed-loop refrigeration circuit at any suitable location. For example, the bottoms liquid 221 may be reintroduced into the same location of the coil-wound heat exchanger from which the vaporized mixed refrigerant was withdrawn (using, for example, the same conduit), or it may, as shown in FIG. 2, be reintroduced into the shell-side of of the coil-wound heat exchanger 10 at an intermediate location of the heat exchanger, such as between the cold 13 and middle 12 tube bundles. Where some or all of the bottoms liquid is to be stored prior to being re-introduced into the coil-wound heat exchanger 10, the bottoms liquid 222 may be stored in a storage vessel that is separate from the distillation column, such as in recovery drum 24 shown in FIG. 2, or the bottom of the distillation column 20 may itself be designed to temporarily store the bottoms liquid. If desired, not all of the bottoms liquid generated by the distillation column need be reintroduced into the closed-loop refrigeration circuit and/or stored for subsequent reintroduction into the closed-loop refrigeration circuit. However, in general the reintroduction (and/or the storage and then subsequent reintroduction) of all of the bottoms liquid is preferred.

As discussed above, by reintroducing (or storing and then reintroducing) the bottoms liquid back into the closed-loop refrigeration circuit, the heavier components of the mixed refrigerant (such as for example ethane/ethylene and higher hydrocarbons) can be retained, thereby avoiding the need to replace these components in the mixed refrigerant once normal operation of the liquefaction system is restored, which can be a costly, difficult and time consuming operation. At the same time, by removing a methane enriched stream, formed from the overhead vapor, from the distillation column and from the liquefaction system (either by simply flaring this stream or by putting it to some other use), the difficulties associated with storing the methane and any other additional light components of the mixed refrigerant (such as for example nitrogen) are avoided.

The coolant used in the overhead condenser can come from any suitable source. For example, if available on-site, a liquefied nitrogen (LIN) stream could be used. However, in a preferred embodiment, as shown in FIG. 2, LNG is used as the coolant. The LNG may be taken directly from LNG that is being produced by the liquefaction system (if the the system is operating under turn-down conditions) or it may, as shown, be pumped from the LNG storage tank 14. The LNG stream 209/207 withdrawn from storage tank 14 is pumped by pump 23 to and through the overhead condenser 22 as a coolant. The LNG stream is warmed in the overhead condenser and exits the condenser as warmed natural gas stream 208, which may for example be flared or used as a fuel in a similar manner to methane enriched stream 204, discussed above. If the warmed natural gas stream 208 is two-phase it may be sent back to the LNG storage tank 14 or to a separator (not shown) from which the liquid may be sent to the LNG tank and the vapor flared or used as fuel or refrigerant make-up or for some other use as described previously for the overhead vapor.

Control of the flow of the various streams depicted in FIG. 2 (and other embodiments of the present invention) can be effected by any and all suitable means known in the art. For example, control of the flow the vaporized mixed refrigerant 201 to the distillation column, control of the flow of the bottoms liquid 221 back to the coil-wound heat exchanger, and control of the flow of the methane enriched stream 204 may be effected by one or more suitable flow control devices (for example flow control valves) located on one or more of the conduits transferring or withdrawing these streams. Likewise, flow of the LNG stream 209/207 could be controlled using a flow control device such as a flow control valve, although usually pump 23 will of itself provide adequate flow control.

As described above, in the embodiment shown in FIG. 2 reflux to the distillation column is provided a condensate obtained by condensing at least a portion of the overhead vapor. However, instead of (or in addition to) condensing the overhead vapor, reflux to the distillation column could instead (or additionally) be provided by direct injection of a separate stream of liquid into the top of the distillation column. This is illustrated in FIG. 3, in which a natural gas liquefaction system according to an alternative embodiment of the invention is shown operating under turn-down or shut down conditions.

Referring to FIG. 3, the stream of vaporized mixed refrigerant 201 is again withdrawn from the shell-side of the coil-wound heat exchanger 10 at the cold-end thereof and introduced into the bottom of distillation column 20, which again separates the vaporized mixed refrigerant into an overhead vapor enriched in methane (and any other light components) and a bottoms liquid enriched in heavier components. However, in this embodiment no overhead condenser and associated separator are used to provide reflux to the distillation column. Instead, an LNG stream 209/207 pumped from the LNG storage tank 14 is introduced as a reflux stream into the top of the distillation column, and all of the overhead vapor withdrawn from the top of the distillation column forms methane-enriched stream 204 that is withdrawn from the liquefaction system (and that can, as discussed above, be flared, used as fuel, added to the natural gas feed or sent to pipeline).

Again, in the embodiment shown in FIG. 3 other suitable cold liquid streams where available can be used, instead of or in addition to LNG, to provide reflux to the distillation column. For example, an LIN stream could again be used in place of an LNG stream. However, as the liquid stream is being introduced into the distillation column so that it is brought into direct contact with the mixed-refrigerant contained therein, the composition of the liquid stream should not be such as to unacceptably contaminate the bottoms liquid 221/222 that is being or will subsequently be returned to the closed-loop refrigeration circuit as retained refrigerant. In particular, if the liquid stream contains any components that would constitute contaminants in the mixed-refrigerant, such components should be of sufficiently high volatility and/or should be present in sufficiently low amounts that the amounts of said components in the bottoms liquid withdrawn from the distillation column are insignificant.

In another embodiment, the embodiments shown in FIGS. 2 and 3 could be combined so that reflux to the distillation column is provided both by condensate formed from condensing overhead vapor in an overhead condenser, and by direct injection of a separate stream of liquid into the top of the distillation column.

In the embodiments shown in FIGS. 2 and 3, the vaporized mixed refrigerant stream 201 that is withdrawn from the closed-loop refrigeration system and introduced into the distillation column 20 is withdrawn from the shell-side of the coil-wound heat exchanger 10 at the cold-end thereof. However, in alternative embodiments the vaporized mixed refrigerant stream could be withdrawn from another location of the closed-loop refrigeration circuit.

For example, referring to FIG. 4, a natural gas liquefaction system according to another embodiment of the invention is shown operating under turn-down or shut down conditions. In this embodiment, the vaporized mixed refrigerant stream 201 is still withdrawn from the shell-side of the coil-wound heat exchanger 10 and introduced into the bottom of the distillation column 20. Likewise, the bottoms liquid 221 from the distillation column 20 may again be reintroduced into the shell-side of of the coil-wound heat exchanger 10. However, in this embodiment the vaporized mixed refrigerant stream 201 is withdrawn from an intermediate location of the heat exchanger, such as between the cold 13 and middle 12 tube bundles, and the bottoms liquid is returned to shell-side of the coil-wound heat exchanger at a location closer towards the warm end of the heat exchanger, such as between the middle 12 and warm 11 tube bundles.

Figure 5:
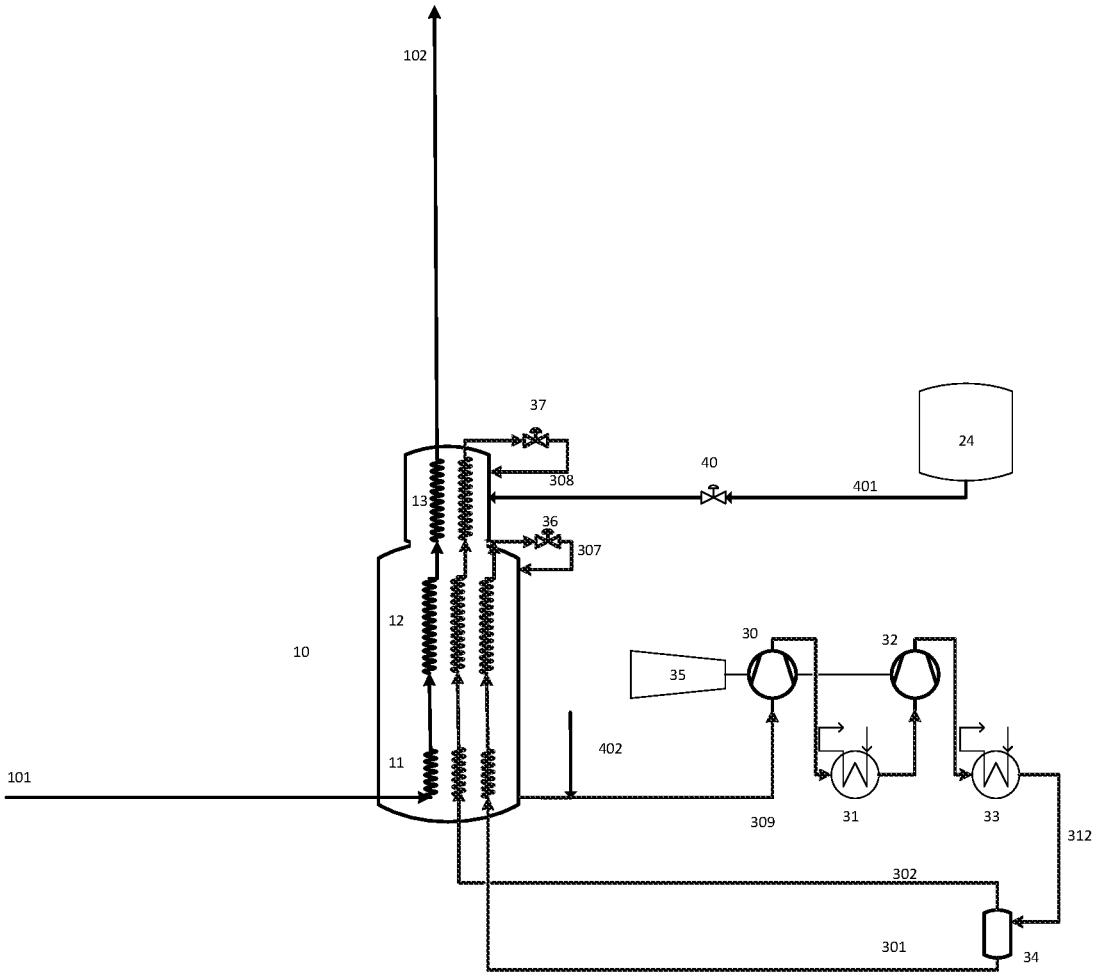
FIG. 5 is a schematic flow diagram depicting a natural gas liquefaction system according to an embodiment of the invention operating during a third period of time during which the production of liquefied and subcooled natural gas is being restored to normal operating conditions and in which refrigerant is being reintroduced into the natural gas liquefaction system.
Figure 6:
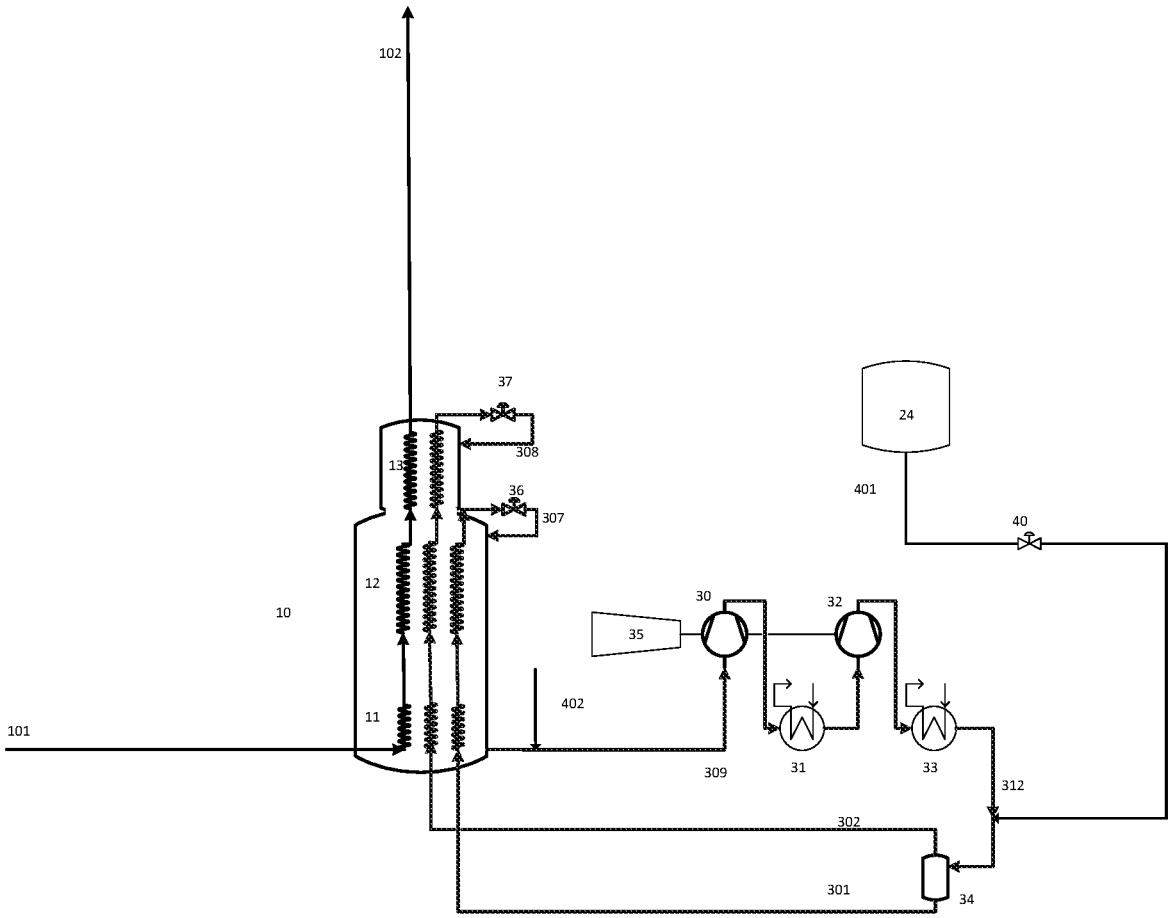
FIG. 6 is a schematic flow diagram depicting a natural gas liquefaction system according to another embodiment of the invention, also operating during a third period of time during which the production of liquefied and subcooled natural gas is being restored to normal operating conditions and in which refrigerant is being reintroduced into the natural gas liquefaction system.

Referring to FIGS. 5 and 6, natural gas liquefaction systems according to embodiments of the invention are shown now operating during a third period of time, during which the production of liquefied and subcooled natural gas is being increased (following shutdown or operation under turn-down conditions) and restored to the normal production rate and in which refrigerant is being reintroduced into the natural gas liquefaction system. For simplicity, features of the liquefaction system that are used for removing refrigerant from the liquefaction system under turn-down or shutdown conditions, such as the distillation column 20 and, where used, overhead condenser 22 described above reference to FIGS. 2 to 4, have not been depicted in FIGS. 5 and 6.

During restoration of normal operation the feed rate of natural gas (i.e. flow rate the natural gas feed stream 101) through the coil-wound heat exchanger 10 and the resulting production rate of LNG (i.e. the flow rate of subcooled, LNG stream 102) is increased until the normal production rate is again reached. Likewise, the circulation rate of the mixed-refrigerant in the closed-loop refrigeration circuit (i.e. the flow rate of the mixed-refrigerant around the circuit and, in particular, through main heat exchanger 10) is increased so as to provide the increased cooling duty that this increase in the LNG production rate requires. In order to provide this increase in the circulation rate of the mixed-refrigerant it is, in turn, necessary to add refrigerant back into the closed-loop refrigeration circuit to provide make-up for the refrigerant previously removed when the liquefaction system was operating under turn-down or shutdown conditions.

In the embodiments shown in FIGS. 5 and 6, bottoms liquid from the distillation column was stored in the recovery drum 24 during the preceding period of time when the liquefaction system was shut down or operating under turn-down conditions, and make-up refrigerant including heavier components of the mixed refrigerant now needs to be reintroduced into the closed-loop refrigeration circuit. As such, the reintroduction of refrigerant back into the closed-loop refrigeration circuit in these embodiments involves the withdrawal of stored bottoms liquid 401 from the recovery drum 24 and reintroduction of said bottoms liquid into the closed-loop refrigeration circuit. As described above in relation to FIGS. 2 to 4, the bottoms liquid can be reintroduced back into the closed-loop refrigeration circuit at any suitable location. For example, as shown in FIG. 5, the bottoms liquid 401 withdrawn from the recovery drum 24 can be expanded, through a expansion device such as J-T valve 40, and reintroduced into the shell-side of the coil-wound heat exchanger near the cold end thereof. Alternatively, as shown in FIG. 6, the bottoms liquid 401 withdrawn from the recovery drum 24 can be expanded and reintroduced into the closed-loop refrigeration circuit downstream of the refrigerant compressors 30 and 32 and aftercooler 33, and upstream of the refrigerant phase separator 34. In both cases, the need for a pump to reintroduce the bottoms liquid into closed-loop refrigeration circuit can be avoided by allowing the pressure of the recovery drum 24 to rise above the operating pressure at the reintroduction point.

The reintroduction of refrigerant back into the closed-loop refrigeration circuit also typically will require the addition of methane and any other light components, such as for example nitrogen, that are designed to be present in the mixed refrigerant and that have been removed from the liquefaction system during the period of turn-down or shutdown operation as part of methane enriched stream 204. It may be preferable that methane and any other light refrigerants are introduced into the closed-loop refrigeration system prior to the reintroduction of the bottoms liquid 401 back into the closed-loop refrigeration system from recovery drum 24. The make-up methane (and any other light components) may be obtained from any suitable source, and may also be introduced into the closed-loop refrigerant at any suitable location.

In particular, as natural gas is mainly methane (typically about 95 mole %) the natural gas supply that provides natural gas feed stream 101 provides a convenient and easy source of make-up methane for the closed-loop refrigeration circuit. As described above, the natural gas feed, prior to being introduced into the coil-wound heat exchanger for liquefaction, is typically scrubbed to remove NGLs. These natural gas liquids are typically processed in a NGL fractionation system (not shown) that includes a series of distillation columns, including a demethanizer column or a scrub column that produces a methane rich overhead. This methane rich overhead may, for example, be used as a make-up methane 402 that can, for example, be added to the closed-loop refrigeration circuit downstream of the coil-wound heat exchanger 10 and upstream of the first refrigerant compressor 30.

EXAMPLE

In order to illustrate the operation of the invention, the process of removing refrigerant from a natural gas liquefaction system as described and depicted in FIG. 2 was simulated using ASPEN Plus software.

The basis of this example is a 5 million metric tons per annum (mtpa) LNG facility using a C3MR cycle which produces about 78,000 lbmoles/h (35380 kgmoles/h) of LNG. The example is a shutdown where the exchanger has been sitting for several hours until the pressure builds to 100 psi (6.8 atm) due to heatleak of about ~130 k btu/hr (38 kW). The simulation represents the initial operation of the distillation column 20. The conditions of the streams are listed in table below. For this example the distillation column is 0.66 ft (20 cm) in diameter, 15 ft (4.57 m) long and contains packing in the form of 1" (2.5 cm) Pall rings. These results show that the distillation column is efficient in separating the light components (methane and nitrogen) from the heavier components (ethane/ethylene, propane and butanes) of the mixed refrigerant, and is thereby effective in retaining and recovering said valuable heavier components during an extended shutdown.

TABLE 1

| | 201 | 204 | 221 | 209 | 208 |
|---|---|---|---|---|---|
| Pressure, psia | 100.00 | 98.63 | 100.00 | 15.20 | 42.75 |
| Temperature, F. | 20.00 | −207.58 | −58.62 | −257.08 | −216.40 |
| Vapor Fraction | 1 | 1 | 0 | 0 | 0.92 |
| Flow, lbmole/h | 28 | 13 | 15 | 37 | 37 |
| Molar Composition | | | | | |
| N2 | 0.0651 | 0.1364 | 0.0010 | 0.0000 | 0.0000 |
| C1 | 0.4262 | 0.8626 | 0.0339 | 0.9600 | 0.9600 |
| C2 | 0.3438 | 0.0010 | 0.6520 | 0.0200 | 0.0200 |
| C3 | 0.1649 | 0.0000 | 0.3131 | 0.0110 | 0.0110 |
| I4 | 0.0000 | 0.0000 | 0.0000 | 0.0050 | 0.0050 |
| C4 | 0.0000 | 0.0000 | 0.0000 | 0.0040 | 0.0040 |

It will be appreciated that the invention is not restricted to the details described above with reference to the preferred embodiments but that numerous modifications and variations can be made without departing from the spirit or scope of the invention as defined in the following claims.

The invention claimed is:

1. A method of removing refrigerant from a natural gas liquefaction system during shutdown, turndown, or other occurrences or upset situations, the liquefaction system being a liquefaction system that uses a mixed refrigerant to liquefy and/or subcool natural gas, the mixed refrigerant comprising a mixture of methane and one or more heavier components, and the liquefaction system comprising a closed-loop refrigeration circuit in which the mixed refrigerant is circulated when the liquefaction system is in use, the closed-loop refrigeration circuit including a main heat exchanger through which natural gas is fed to be liquefied and/or subcooled by indirect heat exchange with the circulating mixed refrigerant, the method comprising:

(a) withdrawing vaporized mixed refrigerant from the closed-loop refrigeration circuit; wherein the vaporized mixed refrigerant is withdrawn from a shell side of the main heat exchanger;

(b) introducing the vaporized mixed refrigerant into a distillation column and providing reflux to the distillation column so as to separate the vaporized mixed refrigerant into an overhead vapor enriched in methane and a bottoms liquid enriched in heavier components;

(c) withdrawing overhead vapor from the distillation column to form a methane enriched stream that is removed from the liquefaction system; and (d) reintroducing bottoms liquid from the distillation column into the closed-loop refrigeration circuit, and/or storing bottoms liquid such that it can subsequently be reintroduced into the closed-loop refrigeration circuit.

2. The method of claim 1, wherein the heavier components comprise one or more heavier hydrocarbons.

3. The method of claim 1, wherein the mixed refrigerant further comprises nitrogen, the overhead vapor in step (b) is enriched in nitrogen and methane, and the methane enriched stream in step (c) is a nitrogen and methane enriched stream.

4. The method of claim 1, wherein in step (b) reflux to the distillation column is provided by a reflux stream of condensate obtained by cooling and condensing at least a portion of the overhead vapor in an overhead condenser by indirect heat exchange with a coolant.

5. The method of claim 4, wherein the coolant comprises a liquefied natural gas stream taken from liquefied natural gas that is being or has been produced by the liquefaction system.

6. The method of claim 1, wherein in step (b) reflux to the distillation column is provided by a reflux stream of liquid introduced into the top of the distillation column.

7. The method of claim 6, wherein the reflux stream of liquid comprises a stream of liquefied natural gas taken from liquefied natural gas that is being or has been produced by the liquefaction system.

8. The method of claim 1, wherein in step (d) the bottoms liquid is stored in the bottom of the distillation column and/or is withdrawn from the distillation column and stored in a separate storage vessel prior to being reintroduced into the closed-loop refrigeration circuit.

9. The method of claim 1, wherein in step (a) the vaporized mixed refrigerant is withdrawn from a cold end of or from an intermediate location of the main heat exchanger.

10. The method of claim 1, wherein the main heat exchanger is a coil-wound heat exchanger.

11. A natural gas liquefaction system that uses a mixed refrigerant, comprising a mixture of methane and one or more heavier components, to liquefy and/or subcool natural gas, the natural gas liquefaction system being configured so as to be capable of performing the method of claim 1 by which refrigerant can be removed during shutdown, turndown, or other occurrences or upset situations, the liquefaction system comprising:

a closed-loop refrigeration circuit for containing and circulating the mixed refrigerant when the liquefaction system is in use, the closed-loop refrigeration circuit including a main heat exchanger through which natural gas can be fed to be liquefied and/or subcooled by indirect heat exchange with the circulating mixed refrigerant;

a distillation column for receiving vaporized mixed refrigerant from the closed-loop refrigeration circuit and operable to separate the vaporized mixed refrigerant into an overhead vapor enriched in methane and a bottoms liquid enriched in heavier components of the mixed refrigerant;

means for providing reflux to the distillation column; and conduits for transferring vaporized mixed refrigerant from the closed-loop refrigeration circuit to the distillation column, for withdrawing from the distillation column and removing from the liquefaction system a methane enriched stream formed from the overhead vapor, and for reintroducing bottoms liquid from the distillation column into the closed-loop refrigeration circuit; wherein the conduit for transferring the vaporized mixed refrigerant from the closed-loop refrigeration circuit to the distillation column is configured to withdraw the vaporized mixed refrigerant from a shell side of the main heat exchanger.

12. A system according to claim 11, wherein the apparatus further comprises a storage device for storing bottoms liquid prior to the reintroduction thereof into the closed-loop refrigeration circuit.

13. A system according to claim 12, wherein the storage device for storing the bottoms liquid comprises a bottom section of the distillation column and/or a separate storage vessel.

14. A system according to claim 11, wherein the means for providing reflux to the distillation column comprise an overhead condenser for cooling and condensing at least a portion of the overhead vapor via indirect heat exchange with a coolant so as to provide a reflux stream of condensate.

15. A system according to claim 14, wherein the coolant comprises a liquefied natural gas stream and the apparatus further comprises a conduit for delivering a portion of the liquefied natural gas produced by the liquefaction system to the overhead condenser.

16. A system according to claim 11, wherein the means for providing reflux to the distillation column comprise a conduit for introducing a reflux stream of liquid into the top of the distillation column.

17. A system according to claim 16, wherein the reflux stream of liquid comprises liquefied natural gas and the conduit for introducing the reflux stream delivers a portion of the liquefied natural gas produced by the liquefaction system into the top of the distillation column.

18. A system according to claim 11, wherein the conduit for transferring vaporized mixed refrigerant from the closed-loop refrigeration circuit to the distillation column withdraws vaporized mixed refrigerant from a cold end of and/or from an intermediate location of the main heat exchanger.

19. A system according to claim 11, wherein the main heat exchanger is a coil-wound heat exchanger.

* * * * *